US006543742B2

(12) United States Patent
Wells

(10) Patent No.: US 6,543,742 B2
(45) Date of Patent: Apr. 8, 2003

(54) FOOTING FORM

(75) Inventor: Donald Wells, Colchester, VT (US)

(73) Assignee: SoundFootings, LLC

( * ) Notice: Subject to any disclaimer, the term of this patent is extended or adjusted under 35 U.S.C. 154(b) by 0 days.

(21) Appl. No.: 09/992,575

(22) Filed: Nov. 6, 2001

(65) Prior Publication Data

US 2002/0079424 A1 Jun. 27, 2002

Related U.S. Application Data

(60) Provisional application No. 60/246,245, filed on Nov. 6, 2000.

(51) Int. Cl.[7] ..... E04G 13/02
(52) U.S. Cl. ..... 249/51; 249/48
(58) Field of Search ..... 249/13, 18, 48, 249/51; 52/292, 294, 295, 296, 297, 298

(56) References Cited

U.S. PATENT DOCUMENTS 1,947,413 A * 2/1934 Hay ..... 249/48
4,648,220 A 3/1987 Gebelius
4,673,157 A 6/1987 Wells
4,767,241 A 8/1988 Wells
4,830,543 A 5/1989 Joubert
5,271,203 A 12/1993 Nagle
5,785,459 A 7/1998 Swinimer
5,800,727 A * 9/1998 Croghan ..... 249/51
5,890,333 A * 4/1999 Boroviak ..... 249/48
6,318,700 B1 * 11/2001 Cliff ..... 249/13

* cited by examiner

*Primary Examiner*—Michael Safavi
(74) *Attorney, Agent, or Firm*—McDermott, Will & Emery

(57) ABSTRACT

A form for molding a footing at an end of another form for molding a pillar. The footing form includes a rigid hollow base having a bottom, an open top and a side wall extending upwardly from the bottom to the open top, and wherein the bottom is larger than the open top. A sleeve extends upwardly from the open top of the base for being received within an end of a pillar form. The footing form also includes protrusions extending laterally outwardly from an outer surface of the sleeve for frictionally engaging an inner surface of the pillar form, yet preventing the inner surface of the pillar form from engaging the outer surface of the sleeve. Accordingly, the overall contact area between the footings is reduced for easier application of the pillar form onto the sleeve of the footing form.

30 Claims, 4 Drawing Sheets

FOOTING FORM

CROSS REFERENCE TO RELATED APPLICATION

The present application claims priority to provisional U.S. patent application Ser. No. 60/246,245, filed Nov. 6, 2000, which is assigned to the assignee of the present invention and incorporated herein by reference.

BACKGROUND OF DISCLOSURE

1. Field of Disclosure

The present disclosure relates to forms for molding settable materials such as concrete, polymer concrete or the like and, in particular, to forms for molding footings for structural pillars.

2. Description of Related Art

The use of structural pillars in the construction industry is well known and widely practiced. Such pillars, are constructed using a settable material such as concrete which is typically poured into a tubular form. Tubular pillar forms made of spirally wrapped paper are well known and commonly used for this purpose. Such tubular pillar form are sold, for example, under the trademark SONOTUBE® by Sonoco Packaging Services of Devens, Mass.

Structural pillars are usually set on a coarse aggregate bed, to ensure good drainage, laid in a trench dug below the level of maximum frost penetration to minimize movement due to frost heaving. A footing for each pillar is required between the aggregate bed and the pillar to distribute weight and provide adequate support for the pillar and the pillar's load.

Traditionally, the forms for this footing have been built in situ using plywood or wooden planks which are cut to form a rectangular frame that is nailed together and set on the aggregate bed. The rectangular frame generally includes at least one cross-piece for supporting the tubular form for the pillar. There are several disadvantages to this practice. First, the cutting and nailing together of materials for the form for the footing is labor intensive and time consuming. Second, such forms do not generally fill properly when concrete is fed through the top of the tubular form. Usually, at least the corners of the form are not properly filled. In addition, air pockets often form around the cross-piece for supporting the tubular form, and the cross-piece itself must be left in the concrete after it is set and the form is removed. All of these factors contribute to an inferior footing which is subject to the intrusion of water that may damage and weaken the footing.

Furthermore, unless the top of the wooden footing form is closed, earth cannot be back-filled around the form before the concrete is poured. This often contributes to inconvenience and unfavorable working conditions. Even if the top of the footing form is closed, most building codes require that any forming material made of wood be removed before back-filling, since buried wood holds moisture that, can cause frost damage.

Prefabricated molds, therefore, have been provided to overcome the disadvantages of wooden forms. For example, U.S. Pat. Nos. 4,673,157 and 4,767,241 to Wells (the '157 and '241 patents), which are both assigned to the assignee of the present disclosure, show a plastic, single piece, prefabricated form for molding a footing in conjunction with tubular forms for pillars.

The '157 and '241 patents beneficially disclose an inexpensive, one-time-use, prefabricated footing form usable with conventional tubular pillar forms of different diameters, so that pillars and footings can be poured at the same time. The footing form disclosed by the '157 and '241 patents was a great advancement in the field of concrete forms in the sense that the form allows all excavation and back-filling to be done relatively quickly (e.g., in one day) prior to pouring of the concrete. The disclosed form also allows the concrete to be poured all on the same day, resulting in significant savings in labor costs as well as expediting the entire construction project.

SUMMARY OF DISCLOSURE

The present disclosure provides an improved form for molding a footing of a settable structural material, such as concrete, at an end of a form for molding a pillar. The footing form includes a longitudinal axis, a hollow base having a bottom, an open top for allowing the base to receive the settable structural material, and a side wall extending upwardly from the bottom to the open top, coaxial with the longitudinal axis. Preferably, the bottom is larger than the open top of the base such that at least a portion of the side wall slopes inwardly between the bottom and the top.

A sleeve extends upwardly from the open top of the base, also coaxial with the longitudinal axis, for being received within the end of the pillar form. The footing form additionally includes protrusions extending laterally outwardly from an outer surface of the sleeve for frictionally engaging an inner surface of the pillar form, yet preventing the inner surface of the pillar form from engaging the outer surface of the sleeve.

The protrusions accordingly, make placing a tubular pillar form onto the footing form easier since the total contact area between the forms is reduced, thereby reducing friction. In addition, the protrusions more easily accommodate cross-sections of pillar forms that have been damaged and misshaped during shipping and handling prior to the pillar forms being placed on the footing form.

According to one aspect of the present disclosure, the protrusions are uniformly spaced around the sleeve and are arranged in at least one annular array coaxial with the axis. Each protrusion of the array extends a uniform distance from the axis to define an outermost periphery of the array.

According to another aspect, the at least one array of protrusions comprises a plurality of arrays successively positioned between the open top of the base and a open top of the sleeve.

According to an additional aspect, the respective protrusions of the arrays are sized such that the outermost peripheries of the arrays decrease monotonically between the open top of the base and the open top of the sleeve for frictionally engaging pillar forms of different inner dimensions.

These and other features and benefits of the present disclosure will become more apparent upon reading the following specification in combination with the accompanying drawing figures.

BRIEF DESCRIPTION OF DRAWINGS

A form constructed in accordance with the present disclosure is described by way of example only and with reference to the following drawings, wherein.

Like reference characters designate identical or corresponding components and units throughout the several views.

DETAILED DESCRIPTION OF DISCLOSURE

Figure 1:
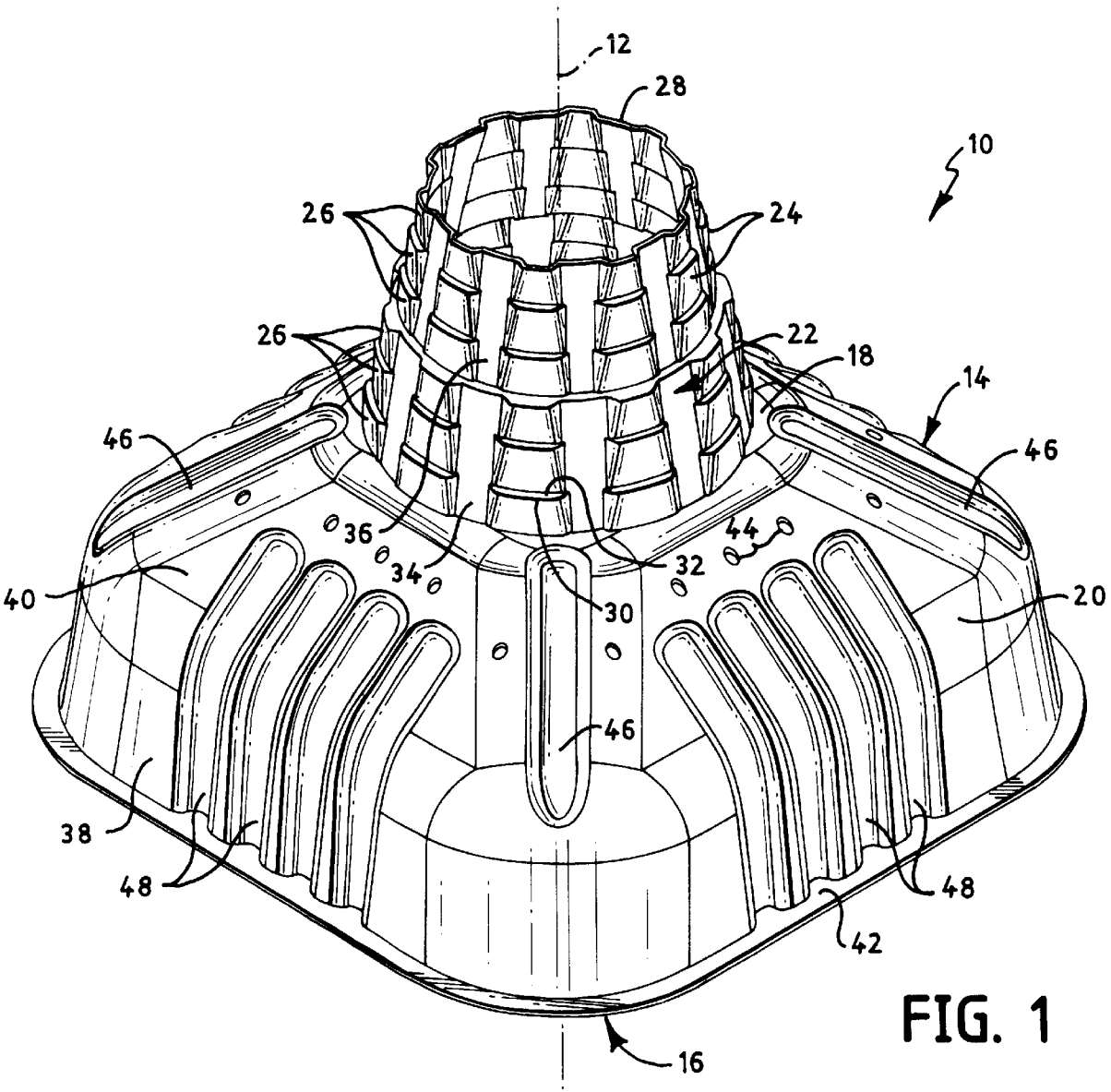
FIG. 1 is a perspective view of the prefabricated footing form.
Figure 2:
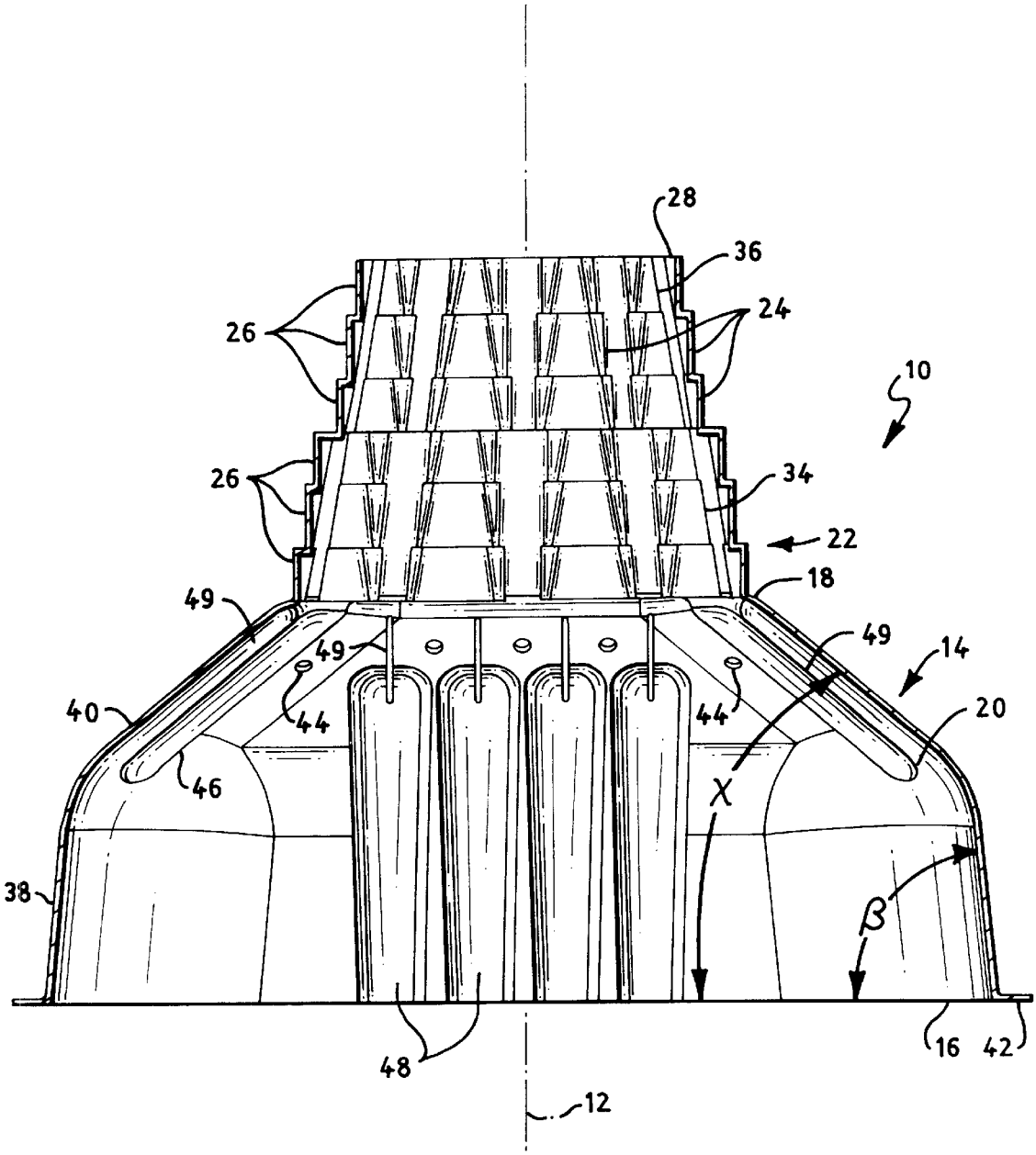
FIG. 2 is a sectional view of the form of FIG. 1, taken along line 2—2 of FIG. 3.
Figure 3:
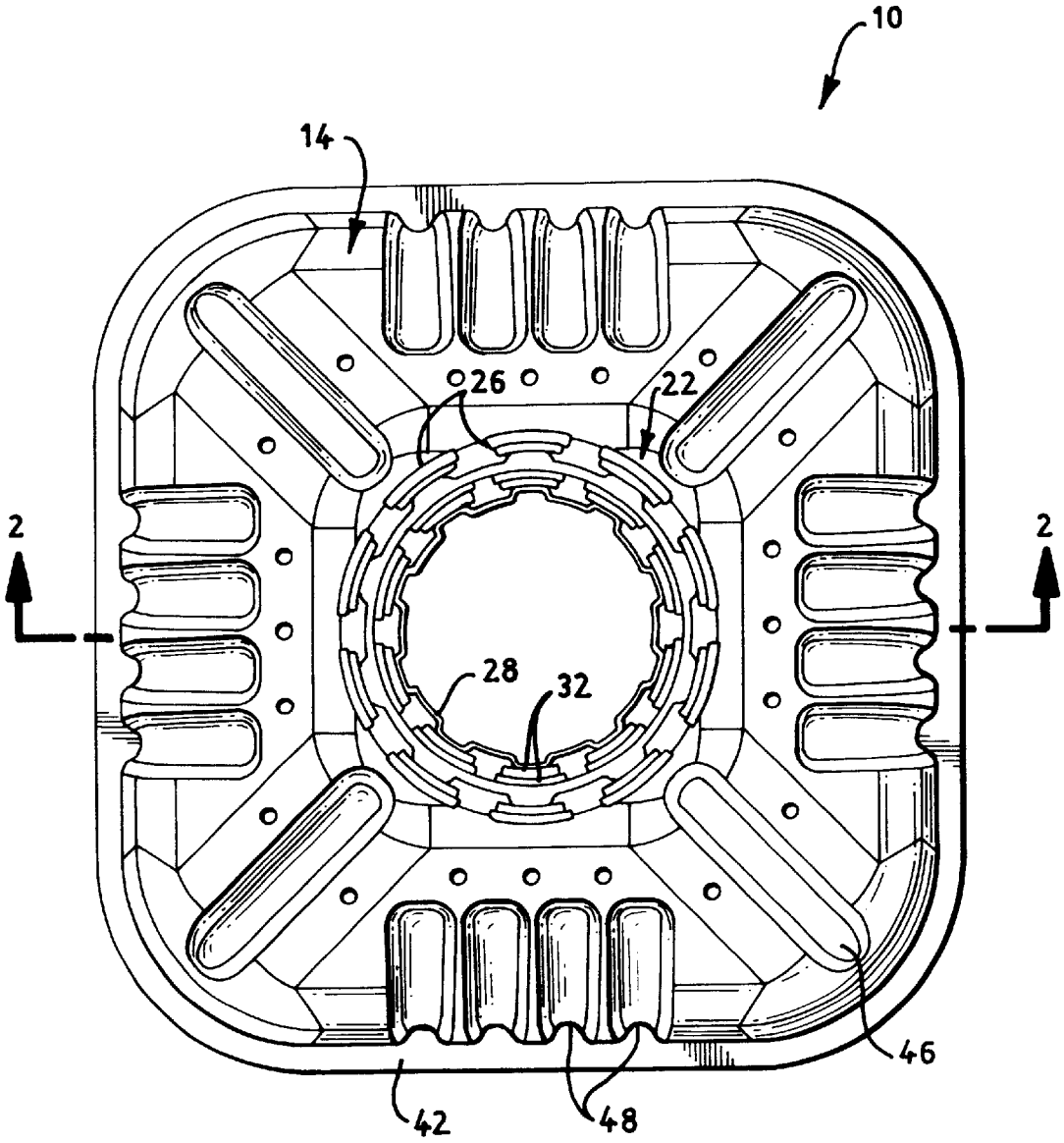
FIG. 3 is a top plan view of the form of FIG. 1.
Figure 4:
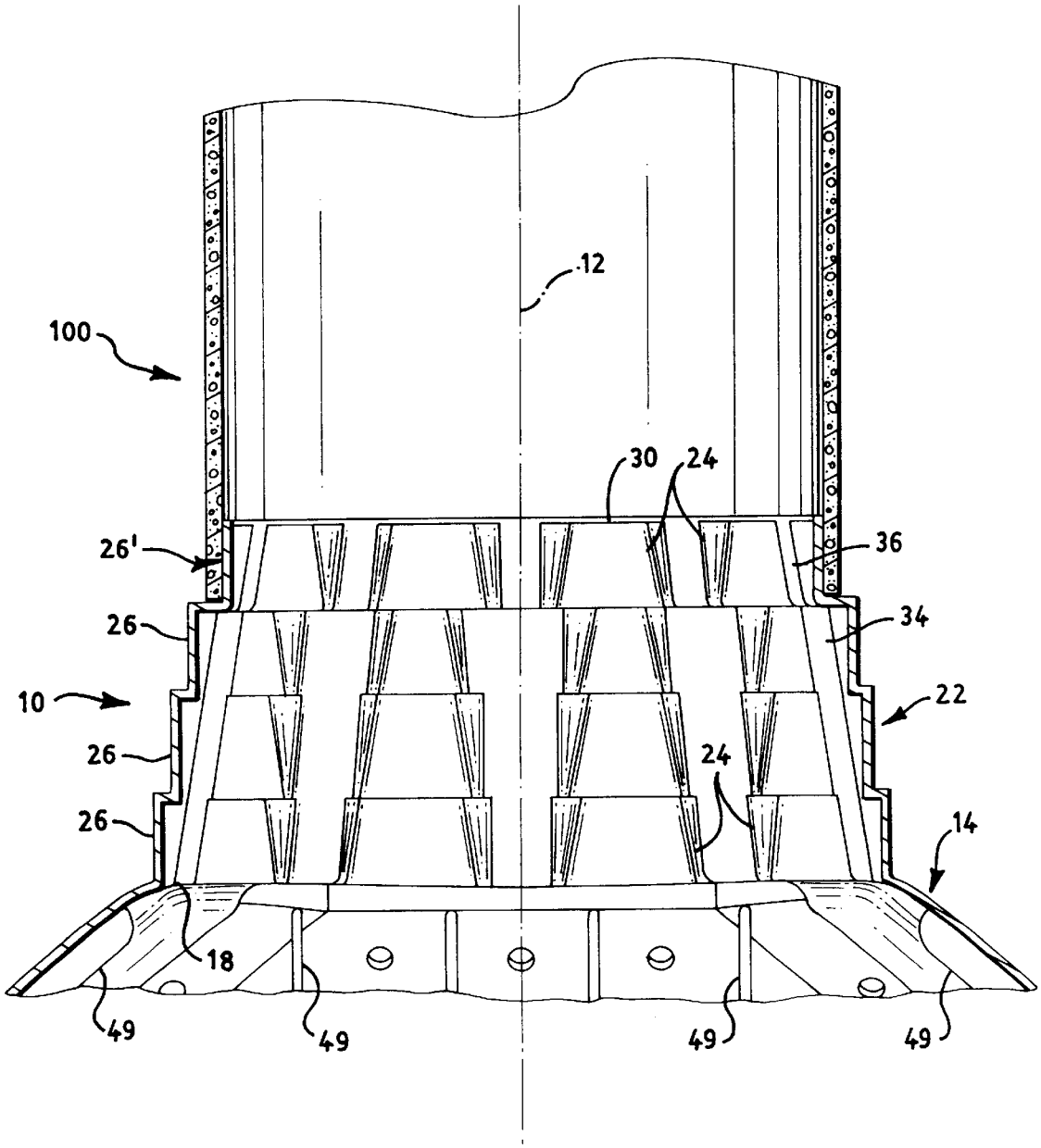
FIG. 4 is a sectional view of a sleeve of the footing form of FIG. 1 and a portion of a tubular pillar form, wherein an uppermost portion of the sleeve has been removed and the pillar form has been positioned on protrusions of the sleeve.

Referring to FIGS. 1 through 4, the present disclosure provides a form 10 for molding a footing of a settable structural material, such as concrete, at an end of a tubular form for molding a pillar (the pillar form 100 is shown in FIG. 4). The footing form 10 includes a longitudinal axis 12, a hollow base 14 having a bottom 16, a shoulder 18 defining an open top for allowing the base to receive the settable structural material, and a side wall 20 extending upwardly from the bottom 16 to the shoulder 18, coaxial with the longitudinal axis 12. Preferably, a cross-sectional area of the bottom 16 is larger than a cross-sectional area of the shoulder 18 such that at least a portion of the side wall 20 slopes inwardly towards the axis 12 between the bottom and the top.

A sleeve 22 extends upwardly from the shoulder 18 and the open top of the base 14, and coaxially with the longitudinal axis 12, for being received within the end of the pillar form 100. The footing form 10 additionally includes protrusions 24 extending laterally outwardly from an outer surface of the sleeve 22 for frictionally engaging an inner surface of the pillar form 100, yet preventing the inner surface of the pillar form from engaging the outer surface of the sleeve.

The protrusions 24 accordingly, make placing a tubular pillar form onto the footing form 10 easier since the total contact area between the forms is reduced, thereby reducing friction. In addition, the protrusions 24 more easily accommodate cross-sections of pillar forms that have been damaged and misshapen during shipping and handling prior to the pillar forms being placed on the footing form 10.

The protrusions 24 preferably are uniformly spaced around the sleeve 22 and are arranged in at least one annular array 26 coaxial with the axis 12. As best shown in FIG. 3, each protrusion of the array 26 extends a uniform distance from the axis 12 of the footing 10 to define an outermost periphery of the array. As shown in all the figures, the footing 10 includes a plurality of arrays 26 successively positioned between the open top 18 of the base and an open top 28 of the sleeve. The respective protrusions of the arrays 26 are sized such that the outermost peripheries of the arrays decrease monotonically between the open top 18 of the base and the open top 28 of the sleeve for frictionally engaging pillar forms of different inner dimensions. If the array to which the tubular pillar form connects is not the top most array of the sleeve, a portion of the sleeve located above the array used may be cut off using a hand saw or the like before the pillar form is seated to ensure that the resulting structural column is not weakened by the presence of the excess sleeve. FIG. 4 shows the pillar form 100 positioned on an array 26' of protrusions of the sleeve 22, with an uppermost portion of the sleeve 22 above the array 26' removed.

Referring to FIGS. 1–4, the protrusions are unitarily formed with the sleeve 22, and include top edges 30 spaced from the surface of the sleeve and defining openings 32. The open tops 32 of the protrusions allow uppermost portions of the sleeve to be more easily cut off. The open tops 32 of the protrusions also provide additional passages for allowing air to evacuate the form when the form is filled with cement. As shown, the protrusions 24 have outer surfaces that are curved to match the outermost periphery of the corresponding arrays. It should be noted that although the sleeve and the arrays are circular to match the circular cross-section of the tubular pillar form, the sleeve and the arrays can be provided with other shapes to match pillar forms of different shapes (e.g., square).

The sleeve 22 includes first and second portions 34, 36 having different cross-sectional dimensions, and each portion of the sleeve includes three arrays 26 of protrusions. Each portion 34, 36 of the sleeve has an inner periphery which decreases monotonically between the open top of the base and the open top of the sleeve, so that the sleeve slopes inwardly toward its open top. The sleeve 22 is unitarily formed with the base 14, however, the sleeve may be provided as removably attachable with respect to the base. Alternatively, the sleeve can be tapered in stead of stepped.

The hollow base 14 has substantially square lateral cross-sections, however, the base can be provided with cross-sections having other shapes, such as circular or octagonal. The lateral cross-sections of the hollow base 14 decrease monotonically between the bottom 16 and the shoulder 18, so that the base slopes inwardly towards the axis 12 as it extends upwardly between the bottom and the shoulder. In particular, the side wall 20 of the base 14 includes a first portion 38 extending from the bottom 16 of the base and a second portion 40 extending between the first portion 38 and the shoulder 18 of the base. The second portion 40 slopes inwardly towards the axis 12 more than the first portion 38.

As shown best in FIG. 2, the base 14 is formed such that the first portion 38 of the side wall 20 slopes inwardly towards the axis 12 and upwardly from the bottom 16 of the base at an angle "$\beta$" of greater than about 80° and less than about 90°, and the second portion 40 of the side wall slopes inwardly towards the axis 12 and upwardly towards the shoulder 18 of the base at an angle "$\chi$" of greater than about 35° and less than about 45°.

As shown in FIG. 2, the bottom 16 is preferably open to allow a plurality of the forms to be longitudinally nested on top of one another for storage and shipment. A continuous flange 42 extends radially outwardly from the open bottom of the base. At the top of the base, the side wall is curved and smoothly merges with the sleeve 22 to reduce stresses at the resulting juncture between the hardened pillar and the footing. The side wall also includes ports 44 for receiving support wires for supporting structural steel, such as rebar, within the form before the form is filled with cement. The ports 44 provide further passages for allowing air to evacuate the form when the form is filled with cement.

Preferably, corners of the square base each include a reinforcing rib 46 integrally molded with the side wall. The corner reinforcing ribs extend from the top of the first portion of the side wall to the top of the base. The side wall also includes groups of ribs 48 between the corners which extend upwardly from the bottom flange to about three quarters to the top of the sidewall. The corner and side ribs 46, 48 serve to reinforce the base so that the base is self supporting in the event that earth is back-filled around the footing form before the form is filled with a settable material, such as wet concrete. The side reinforcing ribs 48 also help a plurality of the forms to properly nest during storage and shipment. As shown best in FIGS. 2 and 4, the side wall is further reinforced by elongated fins 49 extending between the sleeve and the integral ribs 48 of the base.

The form is made from a suitably strong and rigid material such as a plastic. Preferably, the plastic material is recycled.

After the footing and pillar have hardened, the form can be left in the ground and actually protects the footing from moisture, thus minimizing the risk of frost damage.

Modification to above-described preferred embodiment of the present disclosure may become apparent to those skilled in the art. The scope of the disclosure is therefore intended to be limited solely by the scope of the appended claims.

What is claimed is:

1. A form for molding a footing of a settable structural material at an end of a form for molding a pillar, the end of the form having an inner cylindrical surface having a radius R, comprising:

a hollow base extending along a longitudinal axis and having a bottom, a shoulder defining an open top of the base, and a side wall extending from the bottom to the shoulder along the longitudinal axis, and wherein at least a portion of the side wall slopes inwardly towards the longitudinal axis between the bottom and the shoulder;

a hollow sleeve extending along the longitudinal axis from the shoulder and providing fluid communication with the open top of the base; and at least one set of protrusions extending laterally outwardly from an outer surface of the sleeve and adapted to frictionally engage the inner surface of the end of the pillar form each protrusion of said protrusions having an outermost surface which is cylindrical in cross section with each cylindrical cross section possessing a radius R measured from said longitudinal axis.

2. A form according to claim 1, wherein the protrusions are uniformly spaced on the sleeve.

3. A form according to claim 1, wherein the protrusions are arranged in at least one array about the longitudinal axis.

4. A form according to claim 3, wherein the at least one array of protrusions comprises a plurality of arrays successively positioned between the base and an open top of the sleeve.

5. A form according to claim 4, wherein the respective protrusions of the arrays are sized such that outermost peripheries of the arrays decrease monotonically between the base and the open top of the sleeve.

6. A form according to claim 1, wherein the protrusions are unitarily formed with the surface of the sleeve.

7. A form according to claim 1, wherein the outer surface of the sleeve decreases monotonically between the base and an open top of the sleeve.

8. A form according to claim 7, wherein the sleeve includes at least two portions having different cross-sectional dimensions.

9. A form according to claim 8, wherein the protrusions are arranged in arrays about the longitudinal axis, each portion of the sleeve includes at least two arrays of protrusions, and the respective protrusions of the arrays of each section vary in size.

10. A form according to claim 1, wherein the protrusions include edges spaced from the surface of the sleeve and defining openings facing away from the base and communicating with an interior of the hollow sleeve.

11. A form according to claim 1, wherein the sleeve has a circular cross-section and extends coaxially with the longitudinal axis.

12. A form according to claim 1, wherein the sleeve is unitarily formed with the base.

13. A form according to claim 1, wherein the side wall of the base includes ports for receiving support wires.

14. A form according to claim 1, wherein the hollow base has substantially square lateral cross-sections.

15. A form according to claim 1, wherein the hollow base has lateral cross-sections decreasing monotonically between the bottom and the shoulder.

16. A form according to claim 1, wherein the side wall is reinforced by a plurality of integral ribs that extend at least a part of the way between the bottom and the shoulder of the base.

17. A form according to claim 1, wherein the side wall is reinforced by elongated fins extending towards the sleeve.

18. A form according to claim 1, wherein the side wall of the base includes a first portion extending from the bottom and a second portion extending between the first portion and the shoulder, and wherein the first portion slopes inwardly towards the axis less than the second portion.

19. A form according to claim 18, wherein the first portion of the side wall slopes inwardly towards the axis from the bottom of the base at an angle of greater than about 80° and less than about 90°.

20. A form according to claim 18, wherein the second portion of the side wall slopes inwardly towards the axis and upwardly towards the shoulder of the base at an angle greater than about 35° and less than about 45°.

21. A form according to claim 1, wherein the bottom of the base is open.

22. A form according to claim 1, wherein a flange extends radially outwardly from the bottom of the base.

23. A form according to claim 1, wherein the form is molded from a plastic material.

24. A form for molding a footing of a settable structural material at an end of a form for molding a pillar, the end of the form having an inner surface, comprising:

a hollow base extending along a longitudinal axis and having a bottom, a shoulder defining an open top of the base, and a side wall extending from the bottom to the shoulder along the longitudinal axis, and wherein at least a portion of the side wall slopes inwardly towards the longitudinal axis between the bottom and the shoulder;

a hollow sleeve extending along the longitudinal axis from the shoulder and providing fluid communication with the open top of the base; and a plurality of protrusions extending laterally outwardly from an outer surface of the sleeve and adapted to frictionally engage the inner surface of the end of the pillar form, wherein the protrusions are arranged in at least one array about the longitudinal axis, wherein the at least one array of protrusions comprises a plurality of arrays successively positioned between the base and an open top of the sleeve, and wherein the respective protrusions of the arrays are sized such that outermost peripheries of the arrays decrease monotonically between the base and the open top of the sleeve.

25. A form for molding a footing of a settable structural material at an end of a form for molding a pillar, the end of the form having an inner surface, comprising:

a hollow base extending along a longitudinal axis and having a bottom, a shoulder defining an open top of the base, and a side wall extending from the bottom to the shoulder along the longitudinal axis, and wherein at least a portion of the side wall slopes inwardly towards the longitudinal axis between the bottom and the shoulder;

a hollow sleeve extending along the longitudinal axis from the shoulder and providing fluid communication with the open top of the base; and a plurality of protrusions extending laterally outwardly from an outer surface of the sleeve and adapted to frictionally engage the inner surface of the end of the pillar form, wherein the outer surface of the sleeve decreases monotonically between the base and an open top of the sleeve, wherein the sleeve includes at least two portions having different cross-sectional dimensions, and wherein the protrusions are arranged in arrays about the longitudinal axis, each portion of the sleeve includes at least two arrays of protrusions, and the respective protrusions of the arrays of each section vary in size.

26. A form for molding a footing of a settable structural material at an end of a form for molding a pillar, the end of the form having an inner surface, comprising:

a hollow base extending along a longitudinal axis and having a bottom, a shoulder defining an open top of the base, and a side wall extending from the bottom to the shoulder along the longitudinal axis, and wherein at least a portion of the side wall slopes inwardly towards the longitudinal axis between the bottom and the shoulder;

a hollow sleeve extending along the longitudinal axis from the shoulder and providing fluid communication with the open top of the base; and a plurality of protrusions extending laterally outwardly from an outer surface of the sleeve and adapted to frictionally engage the inner surface of the end of the pillar form, wherein the side wall of the base includes port for receiving support wires.

27. A form for molding a footing of a settable structural material at an end of a form for molding a pillar, the end of the form having an inner surface, comprising:

a hollow base extending along a longitudinal axis and having a bottom, a shoulder defining an open top of the base, and a side wall extending from the bottom to the shoulder along the longitudinal axis, and wherein at least a portion of the side wall slopes inwardly towards the longitudinal axis between the bottom and the shoulder;

a hollow sleeve extending along the longitudinal axis from the shoulder and providing fluid communication with the open top of the base; and a plurality of protrusions extending laterally outwardly from an outer surface of the sleeve and adapted to frictionally engage the inner surface of the end of the pillar form, wherein the hollow base has substantially square lateral cross-sections.

28. A form for molding a footing of a settable structural material at an end of a form for molding a pillar, the end of the form having an inner surface, comprising:

a hollow base extending along a longitudinal axis and having a bottom, a shoulder defining an open top of the base, and a side wall extending from the bottom to the shoulder along the longitudinal axis, and wherein at least a portion of the side wall slopes inwardly towards the longitudinal axis between the bottom and the shoulder;

a hollow sleeve extending along the longitudinal axis from the shoulder and providing fluid communication with the open top of the base; and a plurality of protrusions extending laterally outwardly from an outer surface of the sleeve and adapted to frictionally engage the inner surface of the end of the pillar form, wherein the side wall of the base includes a first portion extending from the bottom and a second portion extending between the first portion and the shoulder, and wherein the first portion slopes inwardly towards the axis less than the second portion.

29. A form according to claim 28, wherein the first portion of the side wall slopes inwardly towards the axis from the bottom of the base at an angle of greater than about 80° and less than about 90°.

30. A form according to claim 28, wherein the second portion of the side wall slopes inwardly towards the axis and upwardly towards the shoulder of the base at an angle greater than about 35° and less than about 45°.

* * * * *